US011542884B2

(12) United States Patent
Goodall et al.

(10) Patent No.: US 11,542,884 B2
(45) Date of Patent: Jan. 3, 2023

(54) SYSTEM AND METHOD OF HEAT FLOW CALCULATION IN A PHYSICS-BASED PISTON TEMPERATURE MODEL

(71) Applicant: GM GLOBAL TECHNOLOGY OPERATIONS LLC, Detroit, MI (US)

(72) Inventors: James A. Goodall, Hartland, MI (US); Vignesh Vivek, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 292 days.

(21) Appl. No.: 16/724,992

(22) Filed: Dec. 23, 2019

(65) Prior Publication Data

US 2021/0189993 A1 Jun. 24, 2021

(51) Int. Cl.
*F02D 41/30* (2006.01)

(52) U.S. Cl.
CPC ..... *F02D 41/3005* (2013.01)

(58) Field of Classification Search
CPC .... F02D 41/3005; F02D 35/02; F02D 35/026; G06F 17/10
See application file for complete search history.

(56) References Cited

U.S. PATENT DOCUMENTS

| | | | | |
|---|---|---|---|---|
| 8,955,474 | B1 * | 2/2015 | Derbin | F01P 7/14 123/41.35 |
| 9,279,379 | B2 * | 3/2016 | Frampton | F02D 41/1458 |
| 9,458,774 | B2 * | 10/2016 | Yaguchi | F02D 41/22 |
| 10,648,410 | B2 * | 5/2020 | Hanamura | F02D 41/04 |
| 2010/0147269 | A1 * | 6/2010 | Flowers | F02D 15/02 123/51 R |
| 2017/0123392 | A1 * | 5/2017 | Troisi | G01M 15/08 |

* cited by examiner

*Primary Examiner* — David Hamaoui
(74) *Attorney, Agent, or Firm* — Quinn IP Law

(57) ABSTRACT

A system and method of providing real-time calculation of heat flow in an engine. A piston is disposed in a cylinder of an engine block and movable relative to the cylinder in response to combustion inside the cylinder. A temperature of the combustion inside the cylinder, an average temperature of the wall of the cylinder, and a surface area of the wall of the cylinder based on timing of combustion are determined. An estimated temperature of the piston is derived from calculating a heat fraction to the piston in real-time, via a controller, based on the determined temperature of the combustion, the determined average temperature of the wall of the cylinder, and the determined surface area of the wall of the cylinder. A state of the engine is controlled based on the estimated temperature of the piston as derived from the real-time calculation of the heat fraction to the piston.

20 Claims, 2 Drawing Sheets

SYSTEM AND METHOD OF HEAT FLOW CALCULATION IN A PHYSICS-BASED PISTON TEMPERATURE MODEL

INTRODUCTION

Various vehicles have been developed that include an internal combustion engine that produces torque to ultimately drive wheels that propel the vehicles. The internal combustion engine may include an engine block having a cylinder and a wall which cooperate to define a combustion chamber. A piston is disposed in the cylinder and movable relative to the wall in response to combustion. The temperature of the piston changes depending on various operating conditions of the internal combustion engine, such as warming up, etc. Generally, a calibration table is used to predict the temperature of the piston, but such a calibration table uses a table of constants to predict a fraction of heat from combustion to estimate the temperature of the piston.

SUMMARY

The present disclosure provides a method of providing real-time calculation of heat flow in an engine. The engine includes an engine block having a cylinder and a wall that surrounds the cylinder. The engine also includes a piston disposed in the cylinder and movable relative to the wall of the cylinder in response to timing of combustion in a combustion chamber inside the cylinder. The piston is connected to a crankshaft via a connecting rod. A temperature of the combustion inside the cylinder is determined. An average temperature of the wall of the cylinder is determined. A surface area of the wall of the cylinder is determined based on the timing of the combustion. A heat fraction to the piston is calculated in real-time, via a controller, based on the determined temperature of the combustion, the determined average temperature of the wall of the cylinder, and the determined surface area of the wall of the cylinder. A state of the engine is controlled based on an estimated temperature of the piston which is derived from the real-time calculation of the heat fraction to the piston.

The method optionally includes one or more of the following:

A) determining a top surface area of the piston;

B) calculating in real-time the heat fraction to the piston is also based on the determined top surface area of the piston;

C) calculating in real-time the heat fraction to the piston further includes continuously updating the estimated temperature of the piston at each next time step;

D) determining a total burned gas-heat convection rate;

E) calculating in real-time the heat fraction to the piston is also based on the determined total burned gas-heat convection rate;

F) determining the surface area of the wall of the cylinder further comprises determining a displacement of the piston based on an angular position of the crankshaft after top-dead-center;

G) determining the surface area of the wall of the cylinder further comprises determining a radius of the crankshaft and a length of the connecting rod;

H) determining the surface area of the wall of the cylinder further comprises calculating in real-time, the displacement of the piston based on the angular position of the crankshaft after top-dead-center, the radius of the crankshaft, and the length of the connecting rod;

I) the angular position of the crankshaft after top-dead-center is further defined as the angular position of the crankshaft after fifty percent of combustion heat is released;

J) controlling the state of the engine includes injecting fuel into the combustion chamber based on the estimated temperature of the piston as derived from the real-time calculation of the heat fraction to the piston;

K) controlling the state of the engine includes controlling an air-to-fuel ratio of the combustion chamber based on the estimated temperature of the piston as derived from the real-time calculation of the heat fraction to the piston;

L) controlling the state of the engine includes injecting oil into the cylinder around the piston based on the estimated temperature of the piston as derived from the real-time calculation of the heat fraction to the piston;

M) calculating in real-time a rejection fraction based on the determined temperature of the combustion, the determined average temperature of the wall of the cylinder, the determined surface area of the wall of the cylinder, the determined top surface area of the piston, and the estimated temperature of the piston at each next time step; and N) calculating in real-time the heat fraction to the piston is further defined as multiplying the rejection fraction with the total burned gas-heat convection rate.

The present disclosure also provides an engine system for a movable platform. The system includes an engine block having a cylinder and a wall that surrounds the cylinder. The system also includes a crankshaft supported via the engine block and rotatable relative to a longitudinal axis. The system further includes a piston connected to the crankshaft via a connecting rod. The piston is disposed in the cylinder and is movable relative to the wall of the cylinder in response to timing of combustion in a combustion chamber inside the cylinder. The system also includes a controller configured to: determine a temperature of the combustion inside the cylinder, determine an average temperature of the wall of the cylinder, determine a surface area of the wall of the cylinder based on the timing of the combustion, and calculate in real-time, via the controller, a heat fraction to the piston based on the determined temperature of the combustion, the determined average temperature of the wall of the cylinder, and the determined surface area of the wall of the cylinder. The controller is also configured to control a state of the engine based on an estimated temperature of the piston which is derived from the real-time calculation of the heat fraction to the piston.

The system optionally includes one or more of the following:

A) the controller is configured to determine a top surface area of the piston;

B) the controller is configured to calculate in real-time a rejection fraction based on the determined temperature of the combustion, the determined average temperature of the wall of the cylinder, the determined surface area of the wall of the cylinder, the determined top surface area of the piston, and the estimated temperature of the piston at each next time step;

C) the controller is configured to determine a total burned gas-heat convection rate, and the calculated real-time heat fraction to the piston further includes the controller being configured to multiply the rejection fraction with the total burned gas-heat convection rate;

D) the controller is configured to control the state of the engine, which further includes the controller configured to signal a fuel injector to inject fuel into the combustion chamber based on the estimated temperature of the piston as derived from the real-time calculation of the heat fraction to the piston;

E) the controller is configured to control the state of the engine, which further includes the controller configured to control an air-to-fuel ratio of the combustion chamber based on the estimated temperature of the piston as derived from the real-time calculation of the heat fraction to the piston; and F) the controller is configured to control the state of the engine, which further includes the controller configured to signal an oil injector to inject oil into the cylinder around the piston based on the estimated temperature of the piston as derived from the real-time calculation of the heat fraction to the piston.

The detailed description and the drawings or FIGS. are supportive and descriptive of the disclosure, but the claim scope of the disclosure is defined solely by the claims. While some of the best modes and other configurations for carrying out the claims have been described in detail, various alternative designs and configurations exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims.

Figure 1:
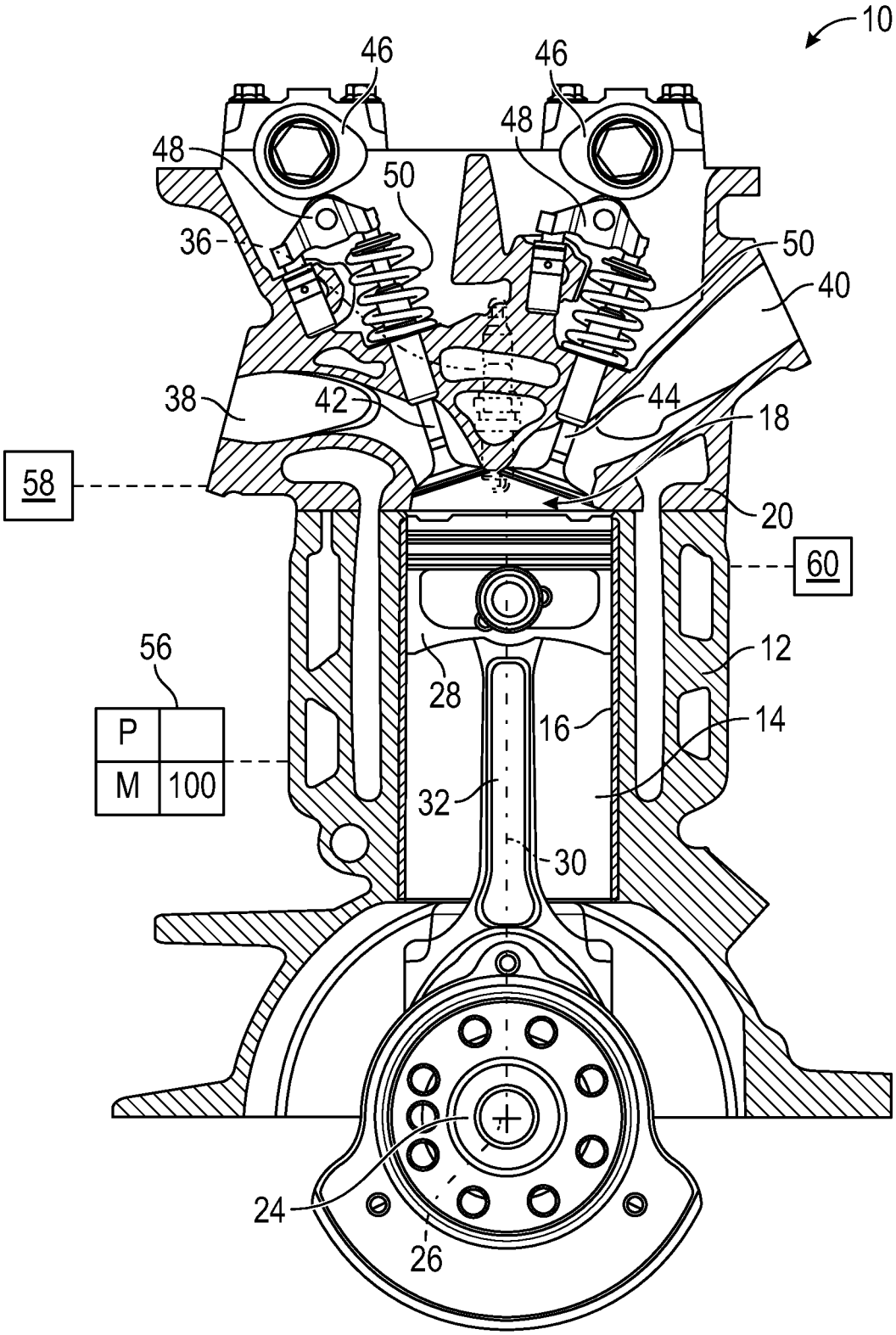
FIG. 1 is a schematic cross-sectional view of an engine for a movable platform, with a piston in a top-dead-center position.

Referring to the FIGS., wherein like numerals indicate like or corresponding parts throughout the several views, an engine 10 for a movable platform, such as a vehicle, is generally shown in FIG. 1. Non-limiting examples of the movable platform may include a car, a truck, a motorcycle, an off-road vehicle, a farm vehicle, a watercraft, an aircraft, or any other suitable moveable platform. Additionally, non-limiting examples of the vehicle application may include a diesel/gas-powered vehicle, a hybrid vehicle, etc. It is to be appreciated that alternatively, the engine 10 may be used in a non-vehicle application, such as, farm equipment, stationary platforms, stationary power plants, robots, etc.

In certain configurations, the engine 10 may be an internal combustion engine, is generally shown in FIG. 1. The engine 10 includes a plurality of components that cooperate to transfer torque, and some of these components are discussed below.

Continuing with FIG. 1, the engine 10 includes an engine block 12 having a cylinder 14 and a wall 16 that surrounds the cylinder 14. The cylinder 14 defines a combustion chamber 18. The engine 10 may include a cylinder head 20 attached to the engine block 12, and include an oil pan that contains a fluid liquid 22, such as oil 22, etc. The engine 10 further includes a crankshaft 24 supported via the engine block 12 and the crankshaft 24 is rotatable relative to a longitudinal axis 26. In certain configurations, the crankshaft 24 is rotatable about the longitudinal axis 26. Torque is transferred from the crankshaft 24, through a transmission and a final drive, ultimately to wheels to propel the movable platform.

Figure 2:
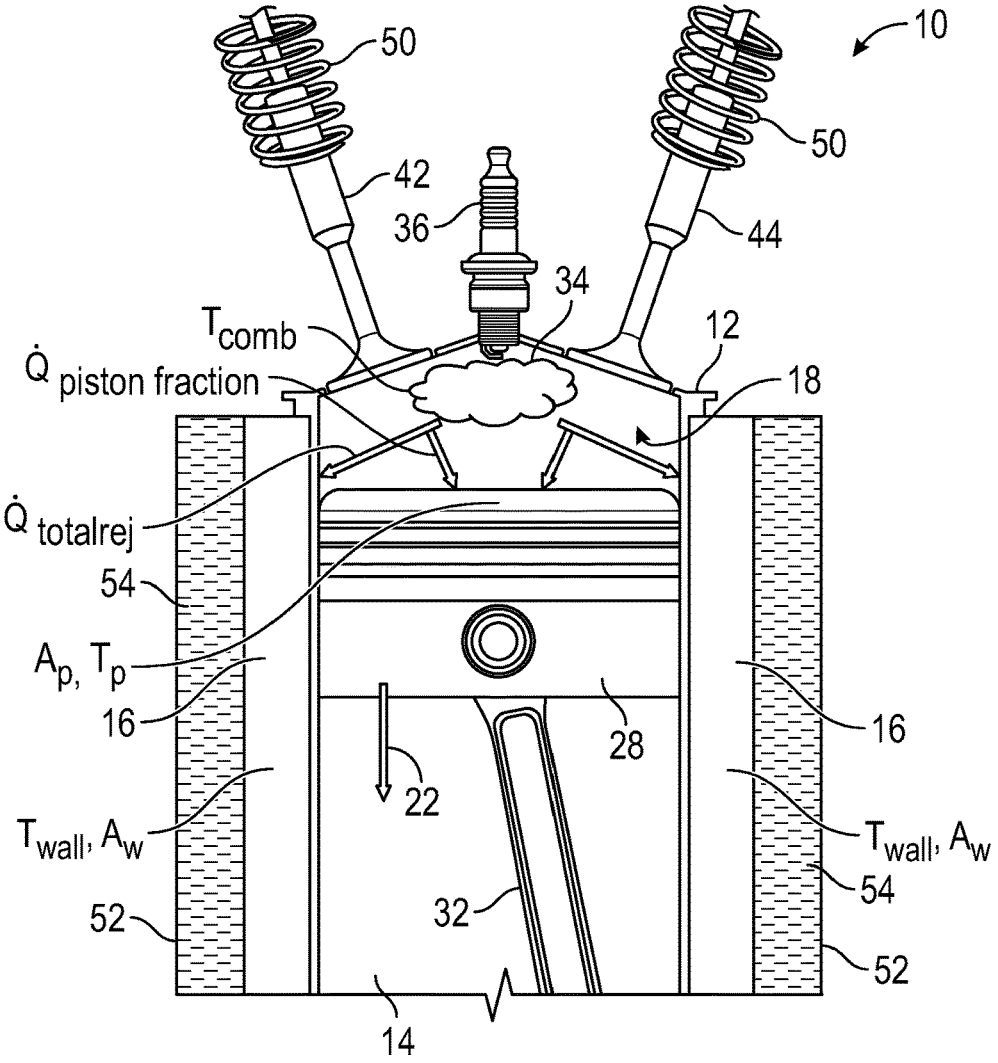
FIG. 2 is a schematic illustration view of the engine with the piston after the top-dead-center position.

Referring to FIGS. 1 and 2, the engine 10 also includes a piston 28 disposed in the cylinder 14 and the piston 28 is movable within the cylinder 14. More specifically, the piston 28 is movable relative to the wall 16 of the cylinder 14 in response to timing of combustion 34 in the combustion chamber 18 inside the cylinder 14. Therefore, the wall 16 of the cylinder 14 surrounds the piston 28 axially relative to a central axis 30. Generally, the central axis 30 is transverse to the longitudinal axis 26, and in certain configurations, the central axis 30 is perpendicular to the longitudinal axis 26.

The piston 28 is connected to the crankshaft 24 via a connecting rod 32. Movement of the piston 28 is caused by combustion 34 in the combustion chamber 18. More specifically, when a spark from a spark plug 36 ignites an air/fuel mixture, combustion 34 occurs which moves the piston 28 along the central axis 30 which in turn causes movement of the connecting rod 32 and crankshaft 24. The timing of combustion 34 (which may also be referred to as combustion timing) determines when combustion 34 occurs to move the piston 28, and combustion timing may be adjusted. Combustion 34 will be discussed further below.

In certain configurations, the engine block 12 may define a plurality of cylinders 14 spaced from each other, and each of the cylinders 14 have a respective wall 16, with a respective piston 28 disposed in each of the respective cylinders 14. In certain configurations, the cylinder head 20 and the engine block 12 may cooperate to define the cylinders 14. When using a plurality of pistons 28, each of the pistons 28 are connected to the crankshaft 24 via respective connecting rods 32. The pistons 28 may reciprocate in respective cylinders 14 in response to combustion 34 in the combustion chamber 18. Generally, the pistons 28 translate back and forth in the respective cylinders 14 along the central axis 30.

Combustion 34 of the air/fuel mixture applies a force to the piston(s) 28 which causes the piston(s) 28 to move in the respective cylinder(s) 14 which causes the connecting rod(s) 32 to rotate the crankshaft 24 such that the crankshaft 24 outputs torque. Generally, each of the pistons 28 is movable in respective cylinders 14 between a top-dead-center position (which is shown in FIG. 1) and a bottom-dead-center position. The top-dead center position is when the piston 28 is at its highest point in the cylinder 14. Stated differently, the top-dead-center position is when the piston 28 is at the maximum distance away from the longitudinal axis 26. Furthermore, when the piston 28 in the top-dead-center position, the crankshaft 24 is at a crank angle of about zero degrees. Therefore, before the piston 28 reaches the top-dead-center position, the crankshaft 24 is at the crank angle of less than zero degrees. The bottom-dead-center position is when the piston 28 is at its lowest point in the cylinder 14. Said differently, the bottom-dead-center position is when the piston 28 is at the minimum distance away from the longitudinal axis 26.

The cylinder(s) 14 may be arranged in any suitable manner, and non-limiting examples may include a V-engine arrangement, an inline engine arrangement, and a horizontally opposed engine arrangement, as well as using both overhead cam and cam-in-block configurations.

Continuing with FIG. 1, each of the cylinders 14 may define a respective combustion chamber 18. Therefore, if more than one cylinder 14 is being utilized, there will correspondingly be one combustion chamber 18 for each of the cylinders 14. In certain configurations, the engine block 12 and the cylinder head 20 each define part of the combustion chamber 18 for each of the respective cylinders 14. Additionally, the engine block 12 and/or the cylinder head 20 may define one or more intake passages 38 and one or more exhaust passages 40 each disposed adjacent to the respective cylinders 14. Generally, the combustion chamber 18 is disposed between the exhaust passage 40 and the cylinder 14. If more than one cylinder 14 is being utilized, each of the combustion chambers 18 are disposed between respective exhaust passages 40 and the respective cylinders 14. The intake passages 38 and the exhaust passages 40 are in selective fluid communication with each of the combustion chambers 18. Each intake passage 38 may deliver the air/fuel mixture to a respective combustion chamber 18 from an intake manifold. Following combustion 34 of the air/fuel mixture, which may occur when ignited by the spark from the spark plug 36, the exhaust passage 40 carries exhaust gases out of the combustion chamber 18 and away from the engine block 12.

Continuing with FIG. 1, the engine 10 may also include one or more intake valves 42 and one or more exhaust valves 44 cooperating with the respective cylinders 14. In certain configurations, each of the cylinders 14 may have one or more intake valves 42 cooperating therewith and one or more exhaust valves 44 cooperating therewith. For example, each of the cylinders 14 may have two exhaust valves 44 and two intake valves 42 cooperating therewith. In certain embodiments, the intake and exhaust valves 42, 44 are supported by the cylinder head 20.

The intake valves 42 are movable between a first position blocking fluid communication through the intake passage 38 and a second position allowing fluid communication through the intake passage. Therefore, the intake valves 42 control when the air/fuel mixture may enter the combustion chamber 18. For illustrative purposes, FIG. 1 illustrates the intake valve 42 in the first position blocking the intake passage. An eccentric portion of a camshaft 46 cooperates with the intake valve 42. When the eccentric portion of the camshaft 46 rotates to a certain position, the eccentric portion moves a rocker 48, and the rocker 48 moves the intake valve 42 to the second position. Once the eccentric portion moves past the rocker 48, a return spring 50 moves the intake valve 42 back to the first position which closes the intake passage 38.

The exhaust valves 44 are movable between a first position blocking fluid communication through the exhaust passage 40 and a second position allowing fluid communication through the exhaust passage. Therefore, the exhaust valves 44 control when the exhaust gases may exit the combustion chamber 18. For illustrative purposes, FIG. 1 illustrates the exhaust valve 44 in the first position blocking the exhaust passage. An eccentric portion of a camshaft 46 cooperates with the exhaust valve. When the eccentric portion of the camshaft 46 rotates to a certain position, the eccentric portion moves a rocker 48, and the rocker 48 moves the exhaust valve 44 to the second position. Once the eccentric portion moves past the rocker 48, a return spring 50 moves the exhaust valve 44 back to the first position which closes the exhaust passage 40.

Generally, as the piston 28 moves between the top-dead-center position and the bottom-dead-center position, the piston 28 creates an intake stroke and the intake valve 42 is correspondingly in the second position to allow the air/fuel mixture to enter the combustion chamber 18. Furthermore, as the piston 28 moves between the bottom-dead-center position and the top-dead-center position, the piston 28 creates an exhaust stroke and the exhaust valve 44 is correspondingly in the second position to allow the exhaust gases to exit the combustion chamber 18. The engine block 12 may include one or more channels 52 that contain a coolant 54 to cool the wall(s) 16 of the cylinder(s) 14 during operation of the engine 10.

Various parameters or states of the engine 10 and the movable platform are monitored, etc., and the collected data may be used to adjust various models and/or operation of the engine 10. Therefore, a controller 56 may be in communication with the engine 10, as well as other components of the movable platform. The controller 56 may control/operate various parameters or states of the engine 10 and/or other components of the movable platform. It is to be appreciated that in certain configurations more than one controller 56 may be used.

Depending on an operation condition of the engine 10, the temperature of the piston 28 may change. For example, during warm-up of the engine 10, the engine block 12 (and specifically the wall 16 of the cylinder 14) and the piston 28 may be cold as the piston 28 starts to move in the cylinder 14, and as the engine 10 continues to warm-up, the wall 16 of the cylinder 14 and the piston 28 continues to warm-up as the piston 28 moves therein. The wall 16 of the cylinder 14 and the piston 28 may warm-up to a normal operating temperature after warm-up is completed. Real-time data regarding the temperature of the piston 28 may be used to improve various features of the movable platform. Specifically, it is desirable to provide real-time calculations of the heat flow in the engine 10, and more specifically, real-time calculations of the heat flow to the piston 28, to improve various operating features of the movable platform.

Therefore, a method 100 of providing real-time calculation of heat flow in the engine 10 is disclosed herein. Specifically, the method 100 uses the real-time calculation of heat flow to the piston 28 which provides a more accurate determination of heat flow in the engine 10. This real-time calculation may be implemented into an algorithm that is a physics-based piston temperature model. The heat flow to the piston 28 is constantly changing or varying with the real-time changing/varying operational conditions of the engine 10.

The method 100 herein does not use a calibration table to represent the heat flow to the piston 28. The calibration table would use a table of constants to predict a heat flow to the piston 28 which does not account for continuous temperature changes during the various operating conditions of the engine 10. As such, the calibration table does not account for real-time changes of the heat flow to the piston 28 during various operating conditions of the engine 10.

Therefore, when referring to real-time calculations of the heat flow to the piston 28, this does not refer to using the calibration table. Instead, the controller 56 continuously calculates the heat flow to the piston 28, in real-time, using various data and calculations discussed further below.

Various advantages may be achieved by the method 100 described herein. For example, a more accurate estimation of the heat flow to the piston 28 may be achieved by using the method 100. As such, a more accurate air-to-fuel delivery to the combustion chamber 18 and/or oil delivery to the cylinder 14 may be achieved by tracking the real-time heat flow to the piston 28. Using the real-time calculation of the heat flow to the piston 28 may also assist in reducing particulate emissions and/or provide a more robust engine 10 by reducing unusual or rare undesired operating scenarios. Furthermore, the life of the piston 28 may be improved by using the real-time calculation of the heat flow. In addition, other calibrations and/or other models of the movable platform may be improved by using the real-time calculation of the heat flow.

Turning back to the controller 56, the controller 56 is programmed to execute instructions embodying the method 100. The controller 56 may be a host machine or distributed system, e.g., a computer such as a digital computer or microcomputer. The controller 56 includes a processor P and a memory M, with the memory M including application-suitable amounts of tangible, non-transitory memory, e.g., read-only memory, whether optical, magnetic, flash, or otherwise. Instructions may be stored in the memory M of the controller 56 and automatically executed via the processor P of the controller 56 to provide the respective control functionality. The controller 56 also includes application-sufficient amounts of random-access memory, electrically-erasable programmable read only memory, and the like, as well as a high-speed clock, analog-to-digital and digital-to-analog circuitry, and input/output circuitry and devices, as well as appropriate signal conditioning and buffer circuitry. Therefore, the controller 56 may include all software, hardware, memory, algorithms, connections, sensors, etc., necessary to control, for example, providing real-time calculation of the heat flow in the engine 10 and adjust various parameters or states of the movable platform in response to the real-time calculation. It is to be appreciated that the controller 56 may also include any device capable of analyzing data from various sensors, comparing data, making the necessary decisions required to control calculate the heat flow and/or various models and/or various states of the engine 10.

Generally, the controller 56 may use, determine, and/or collect, etc., information or data regarding various temperatures (such as the wall 16 of the cylinder 14, the piston 28, the combustion 34, the coolant 54, the oil 22, etc.), position of the crankshaft 24, etc. The controller 56 may be in communication with various sensors, indicators, etc. of the engine 10 and the movable platform, to use, collect, compile, derive, determine, the information or data needed to implement the method 100.

For example, the controller 56 is configured to determine a temperature ($T_{comb}$) of the combustion 34 inside the cylinder 14, and determine an average temperature ($T_{wall}$) of the wall 16 of the cylinder 14. Also, the controller 56 is configured to determine a surface area ($A_w$) of the wall 16 of the cylinder 14 based on the timing of the combustion 34. The controller 56 uses this information to calculate in real-time the heat flow which provides an estimated temperature of the piston 28 that is used to control the state of the engine 10. Specifically, the controller 56 calculates, in real-time, a heat fraction ($\dot{Q}_{PistonFraction}$) to the piston 28 based on the determined temperature of the combustion 34, the determined average temperature of the wall 16 of the cylinder 14, and the determined surface area of the wall 16 of the cylinder 14. The surface area of the wall 16 based on the timing of the combustion 34 and the heat fraction will be discussed further below.

As mentioned above, various operating parameters or states of the movable platform may be adjusted in response to the real-time calculations. For example, a state of the engine 10 is controlled based on the estimated temperature of the piston 28 which is derived from the real-time calculation of the heat fraction to the piston 28. Various states of the engine 10 may be controlled in response to determining the real-time heat flow, or more specifically, the heat fraction to the piston 28 which provides the estimated temperature of the piston 28 that is used in various models. In certain configurations, the controller 56 is configured to control one or more of the states of the engine 10. For example, the controller 56 may control or signal a fuel injector 58 to inject fuel into the combustion chamber 18 based on the estimated temperature of the piston 28 as derived from the real-time calculation of the heat fraction to the piston 28. As another example, the controller 56 may control an air-to-fuel ratio of the combustion chamber 18 based on the estimated temperature of the piston 28 as derived from the real-time calculation of the heat fraction to the piston 28. As yet another example, the controller 56 may control or signal an oil injector 60 to inject the oil 22 into the cylinder 14 around the piston 28 based on the estimated temperature of the piston 28 as derived from the real-time calculation of the heat fraction to the piston 28. In certain configurations, the controller 56 may control more than one state of the engine 10, and other states are possible, such as the temperature of the coolant 54, timing of the intake and/or exhaust valves 42, 44, etc.

The piston 28 changes positions relative to the wall 16 of the cylinder 14 due to the combustion 34, which changes the exposed area of the wall 16 of the cylinder 14. Therefore, the exposed area of the wall 16 changes with the timing of the combustion 34. The exposed area of the wall 16 of the cylinder 14 affects the heat fraction between the piston 28 and the wall 16 of the cylinder 14; and therefore, a rejection fraction is determined via the controller 56 and is used to determine the heat fraction ($\dot{Q}_{PistonFraction}$) to the piston 28. In certain configurations, the controller 56 is configured to determine a top surface area ($A_p$) of the piston 28 and continuously update the estimated temperature ($T_p$) of the piston 28 at each next time step. The controller 56 may use this information to calculate a rejection fraction. Therefore, calculating, in real-time, the heat fraction to the piston 28 may also be based on the determined top surface area of the piston 28 and/or continuously updating the estimated temperature of the piston 28 at each next time step. In various configurations, the controller 56 is configured to calculate in real-time the rejection fraction based on the determined temperature of the combustion 34, the determined average temperature of the wall 16 of the cylinder 14, the determined surface area of the wall 16 of the cylinder 14, the determined top surface area of the piston 28, and the estimated temperature of the piston 28 at each next time step. Therefore, the controller 56 may use equation (1) to calculate the rejection fraction as identified below:

$$\text{Rejection Fraction} = \frac{A_p(T_{comb} - T_p)}{A_p(T_{comb} - T_p) + A_w(T_{comb} - T_{wall})} \tag{1}$$

wherein:

Rejection Fraction=the heat fraction between the piston 28 and the wall 16 of the cylinder 14;

$T_p$=the estimated temperature of the piston 28 (in ° C.) (see FIG. 2);

$T_{comb}$ the temperature of the combustion 34, back-calculated (in ° C.) (see FIG. 2);

$T_{wall}$=the average temperature of the wall 16 of the cylinder 14 (in ° C.) (see FIG. 2);

$A_w$=the surface area of the wall 16 of the cylinder 14 (in $mm^2$) based on the timing of the combustion 34 (see FIG. 2); and $A_p$=the top surface area of the piston 28 (in $mm^2$) (see FIG. 2).

Figure 3:
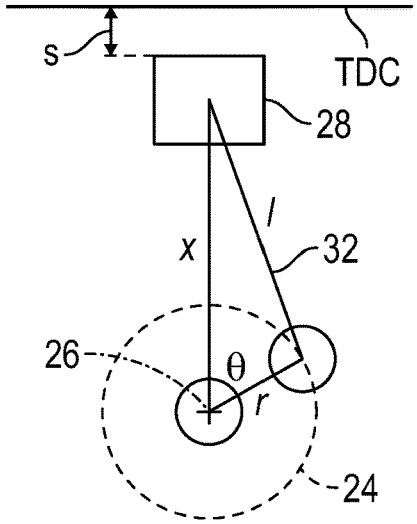
FIG. 3 is a schematic illustration of the piston after the top-dead-center position, with the top-dead-center position identified via line TDC.

The surface area ($A_w$) of the wall 16 of the cylinder 14 may be determined to provide the area of the wall 16 of the cylinder 14 and the exposed area of a head of the piston 28 based on the real-time position of the piston 28 in light of the timing of the combustion 34. To determine the surface area ($A_w$) of the wall 16 of the cylinder 14, as discussed above in equation (1), the controller 56 may also determine data/information regarding a displacement of the piston 28 based on an angular position (Θ) of the crankshaft 24 after top-dead-center, a radius (r) of the crankshaft 24, and a length (l) of the connecting rod 32. The controller 56 may use this data to calculate, in real-time, the surface area ($A_w$) of the wall 16 of the cylinder 14 based on the timing of the combustion 34. More specifically, determining the surface area ($A_w$) of the wall 16 of the cylinder 14 may further include calculating in real-time, the displacement of the piston 28 based on the angular position of the crankshaft 24 after top-dead-center, the radius of the crankshaft 24, and the length of the connecting rod 32. Therefore, the displacement of the piston 28 may be calculated in real-time based on the angular position of the crankshaft 24 after top-dead-center, the radius of the crankshaft 24, and the length of the connecting rod 32, and may use equation (2):

$$s=l+r-x \tag{2}$$

wherein:

s=the displacement of the piston 28 (see FIG. 3);

l=the length of the connecting rod 32 (see FIG. 3);

r=the radius of the crankshaft 24 (see FIG. 3); and x=the distance between the piston 28 and a center of the crankshaft 24 being at the longitudinal axis 26 (see FIG. 3).

The displacement of the piston 28 from equation (2) may be used to determine the surface area ($A_w$) of the wall 16 of the cylinder 14 by using equation ($A_w=(\pi r^2+2\pi rs)*4$) which is a simplified version of equation (3) below:

$$A_w=[\pi r^2+2\pi r(l+r-r\cos(\Theta)+\sqrt{l^2-r^2\sin(\Theta)^2})]*4 \tag{3}$$

wherein:

$A_w$=the surface area of the wall 16 of the cylinder 14 (in $mm^2$) based on the timing of the combustion 34;

r=the radius of the crankshaft 24 (see FIG. 3);

l=the length of the connecting rod 32 (see FIG. 3); and

Θ=the angular position of the crankshaft 24 after top-dead-center at the timing of the combustion 34 (see FIG. 3).

In certain configurations, the angular position of the crankshaft 24 after top-dead-center is further defined as the angular position of the crankshaft 24 after fifty percent of combustion heat is released. Therefore, Θ in equation (3) above may be substituted with CA50, which represents the angular position of the crankshaft 24 after fifty percent of the combustion heat is released (i.e., when fifty percent of combustion is complete).

The controller 56 may use the information determined above from equations 1-3 to determine the heat fraction to the piston 28 which provides the estimated temperature of the piston 28 that is used to control the various states. The estimated temperature of the piston 28 may be used in the piston temperature model or any other suitable model or calculation, etc. Once the rejection fraction is determined, the controller 56 may next calculate the real-time heat fraction to the piston 28. Therefore, the controller 56 is also configured to determine a total burned gas-heat convection rate. The total burned gas-heat convection rate occurs in the cylinder 14. This data may be used to calculate, in real-time, the heat fraction to the piston 28. Therefore, calculating in real-time the heat fraction to the piston 28 is also based on the determined total burned gas-heat convection rate. In certain configurations, the calculated (in real-time) heat fraction to the piston 28 may further include the controller 56 being configured to multiply the rejection fraction with the total burned gas-heat convection rate. The real-time heat fraction ($\dot{Q}_{PistonFraction}$) to the piston 28 may be calculated using equation (4):

$$\dot{Q}_{PistonFraction}=\dot{Q}_{totalrej}(\text{Rejection Fraction}) \tag{4}$$

wherein:

$\dot{Q}_{totalrej}$=the total burned gas heat convection rate, in kW;

Rejection Fraction=equation (1); and $\dot{Q}_{PistonFraction}$=the heat fraction to the piston 28.

The controller 56 may use the real-time heat fraction to the piston 28 to adjust various states of the engine 10 as discussed above based on the estimated temperature of the piston 28. An algorithm may implement the calculated real-time heat fraction to the piston 28 in a physics-based piston temperature model that comprehends the actual amount of heat energy going to the piston 28. By using this algorithm, actual temperature conditions of the piston 28 are implemented instead of calibration tables that use a table of constants to predict a temperature of the piston 28. The estimated temperature of the piston 28 is continuously updated in the method 100 to continuously provide real-time data to more precisely control the state of the engine 10 in real-time which improves various operating features of the movable platform. It is to be appreciated that the order or sequence of performing the method 100 as discussed above is for illustrative purposes and other orders or sequences are within the scope of the present teachings.

While the best modes and other configurations for carrying out the disclosure have been described in detail, those familiar with the art to which this disclosure relates will recognize various alternative designs and configurations for practicing the disclosure within the scope of the appended claims. Furthermore, the configurations shown in the drawings or the characteristics of various configurations mentioned in the present description are not necessarily to be understood as configurations independent of each other. Rather, it is possible that each of the characteristics described in one of the examples of a configuration may be combined with one or a plurality of other desired characteristics from other configurations, resulting in other configurations not described in words or by reference to the drawings. Accordingly, such other configurations fall within the framework of the scope of the appended claims.

What is claimed is:

1. A method of providing real-time calculation of heat flow in an engine including an engine block having a cylinder and a wall that surrounds the cylinder, with a piston disposed in the cylinder and movable relative to the wall of the cylinder in response to timing of combustion in a combustion chamber inside the cylinder, and the piston is connected to a crankshaft via a connecting rod, the method comprising:

determining a temperature of the combustion inside the cylinder;

determining an average temperature of the wall of the cylinder taken only at an angular position of the crankshaft immediately after fifty percent of combustion heat is released to represent a steady-state heat transfer of a stationary theoretical engine at CA50;

determining a surface area of the wall of the cylinder based on the timing of the combustion;

calculating in real-time, via a controller, a heat fraction to the piston based on the determined temperature of the combustion, the determined average temperature of the wall of the cylinder, and the determined surface area of the wall of the cylinder; and controlling a state of the engine based on an estimated temperature of the piston which is derived from the real-time calculation of the heat fraction to the piston.

2. The method as set forth in claim 1:

further comprising determining a top surface area of the piston; and wherein calculating in real-time the heat fraction to the piston is also based on the determined top surface area of the piston.

3. The method as set forth in claim 2 wherein calculating in real-time the heat fraction to the piston further includes continuously updating the estimated temperature of the piston at each next time step.

4. The method as set forth in claim 3:

further comprising determining a total burned gas-heat convection rate; and wherein calculating in real-time the heat fraction to the piston is also based on the determined total burned gas-heat convection rate.

5. The method as set forth in claim 1 wherein determining the surface area of the wall of the cylinder further comprises determining a displacement of the piston based on the angular position of the crankshaft after top-dead-center.

6. The method as set forth in claim 5 wherein determining the surface area of the wall of the cylinder further comprises determining a radius of the crankshaft and a length of the connecting rod.

7. The method as set forth in claim 6 wherein determining the surface area of the wall of the cylinder further comprises calculating in real-time, the displacement of the piston based on the angular position of the crankshaft after top-dead-center, the radius of the crankshaft, and the length of the connecting rod.

8. The method as set forth in claim 5 wherein determining the displacement of the piston based on the angular position of the crankshaft after top-dead-center is further defined as determining the surface area of the wall of the cylinder via displacement of the piston at the angular position of the crankshaft after fifty percent of combustion heat is released.

9. The method as set forth in claim 1 wherein controlling the state of the engine includes injecting fuel into the combustion chamber based on the estimated temperature of the piston as derived from the real-time calculation of the heat fraction to the piston.

10. The method as set forth in claim 1 wherein controlling the state of the engine includes controlling an air-to-fuel ratio of the combustion chamber based on the estimated temperature of the piston as derived from the real-time calculation of the heat fraction to the piston.

11. The method as set forth in claim 1 wherein controlling the state of the engine includes injecting oil into the cylinder around the piston based on the estimated temperature of the piston as derived from the real-time calculation of the heat fraction to the piston.

12. The method as set forth in claim 1 wherein calculating in real-time the heat fraction to the piston further includes continuously updating the estimated temperature of the piston at each next time step.

13. The method as set forth in claim 1:

further comprising determining a top surface area of the piston; and further comprising calculating in real-time a rejection fraction based on the determined temperature of the combustion, the determined average temperature of the wall of the cylinder, the determined surface area of the wall of the cylinder, the determined top surface area of the piston, and the estimated temperature of the piston at each next time step.

14. The method as set forth in claim 13:

further comprising determining a total burned gas-heat convection rate; and wherein calculating in real-time the heat fraction to the piston is further defined as multiplying the rejection fraction with the total burned gas-heat convection rate.

15. The method as set forth in claim 1 wherein calculating in real-time, via the controller, the heat fraction to the piston further comprising calculating the real-time heat fraction to the piston using equation:

$$\dot{Q}_{PistonFraction}=\dot{Q}_{totalrej}(\text{Rejection Fraction})$$

wherein:

$\dot{Q}_{totalrej}$=the total burned gas heat convection rate;

$\dot{Q}_{PistonFraction}$=the heat fraction to the piston;

Rejection Fraction=the heat fraction between piston and the wall of the cylinder calculated via equation:

$$\text{Rejection Fraction} = \frac{A_p(T_{comb} - T_p)}{A_p(T_{comb} - T_p) + A_w(T_{comb} - T_{wall})}$$

wherein:

$T_p$=the estimated temperature of the piston;

$T_{comb}$ the temperature of the combustion, back-calculated;

$T_{wall}$=the average temperature of the wall of the cylinder;

$A_w$=the surface area of the wall of the cylinder based on the timing of the combustion at the angular position of the crankshaft after fifty percent of the combustion heat is released; and $A_p$=the top surface area of the piston.

16. An engine system for a movable platform; the system comprising:

an engine including an engine block having a cylinder and a wall that surrounds the cylinder;

a crankshaft supported via the engine block and rotatable relative to a longitudinal axis;

a piston connected to the crankshaft via a connecting rod, and the piston is disposed in the cylinder and movable relative to the wall of the cylinder in response to timing of combustion in a combustion chamber inside the cylinder; and a controller configured to:

determine a temperature of the combustion inside the cylinder;

determine an average temperature of the wall of the cylinder ta ken only at a n angular position of the crankshaft immediately after fifty percent of combustion heat (CA50) is released to represent a steady-state heat transfer of a stationary theoretical engine at CA50;

determine a surface area of the wall of the cylinder based on the timing of the combustion;

calculate in real-time, via the controller, a heat fraction to the piston based on the determined temperature of the combustion, the determined average temperature of the wall of the cylinder, and the determined surface area of the wall of the cylinder; and control a state of the engine based on an estimated temperature of the piston which is derived from the real-time calculation of the heat fraction to the piston.

17. The system as set forth in claim 16 wherein the controller is configured to:

determining a top surface area of the piston; and calculate in real-time a rejection fraction based on the determined temperature of the combustion, the determined average temperature of the wall of the cylinder, the determined surface area of the wall of the cylinder, the determined top surface area of the piston, and the estimated temperature of the piston at each next time step.

18. The system as set forth in claim 17 wherein the controller is configured to determine a total burned gas-heat convection rate, and wherein the calculated real-time heat fraction to the piston further includes the controller being configured to multiply the rejection fraction with the total burned gas-heat convection rate.

19. The system as set forth in claim 16 wherein the controller is configured to control the state of the engine further includes the controller configured to signal a fuel injector to inject fuel into the combustion chamber based on the estimated temperature of the piston as derived from the real-time calculation of the heat fraction to the piston.

20. The system as set forth in claim 16 wherein the controller is configured to control the state of the engine further includes the controller configured to control an air-to-fuel ratio of the combustion chamber based on the estimated temperature of the piston as derived from the real-time calculation of the heat fraction to the piston.

* * * * *